United States Patent [19]

Patrignani

[11] 3,963,238

[45] June 15, 1976

[54] BOWLING BALL AND GRIPPING DEVICE

[75] Inventor: Jerry M. Patrignani, N. Tarrytown, N.Y.

[73] Assignee: Lawrence Peska Associates, Inc., New York, N.Y. ; a part interest

[22] Filed: Nov. 6, 1975

[21] Appl. No.: 629,372

[52] U.S. Cl. ..... 273/63 A; 273/63 F

[51] Int. Cl.[2] ..... A63B 37/00

[58] Field of Search ..... 273/63 A, 63 B, 63 C, 273/63 D, 63 E, 63 F, 63 G, 63 R, 64, 54 B, 183 C

[56] References Cited

UNITED STATES PATENTS

| | | | |
|---|---|---|---|
| 1,021,490 | 3/1912 | Scully | 273/63 A |
| 2,646,985 | 7/1953 | Nagy et al. | 273/63 A |
| 2,950,111 | 8/1960 | Kunevicius | 273/63 F |
| 2,983,511 | 5/1961 | Stott | 273/63 A |
| 3,004,762 | 10/1961 | Frost | 273/63 B |
| 3,687,458 | 8/1972 | Proctor | 273/183 B |

*Primary Examiner*—George J. Marlo

[57] ABSTRACT

A bowling ball grip that is adapted to be removably inserted into the digit receiving aperture of a bowling ball and thereby provide for a secure fit.

8 Claims, 3 Drawing Figures

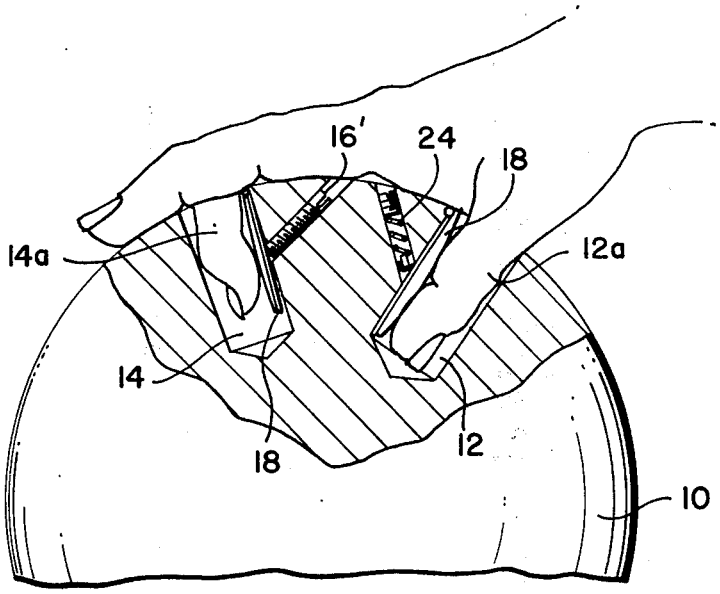
FIG. 1
FIG. 3
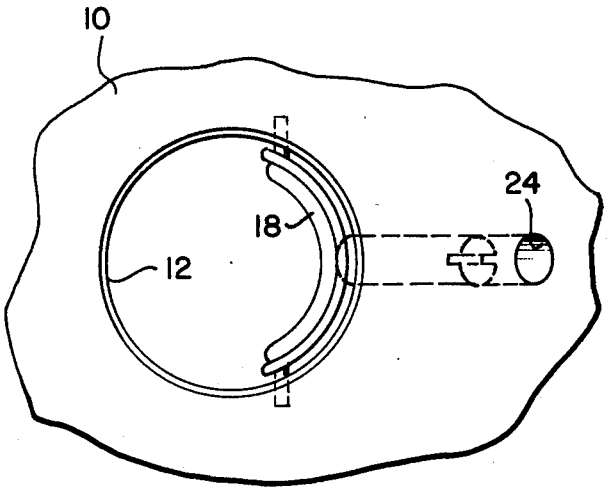
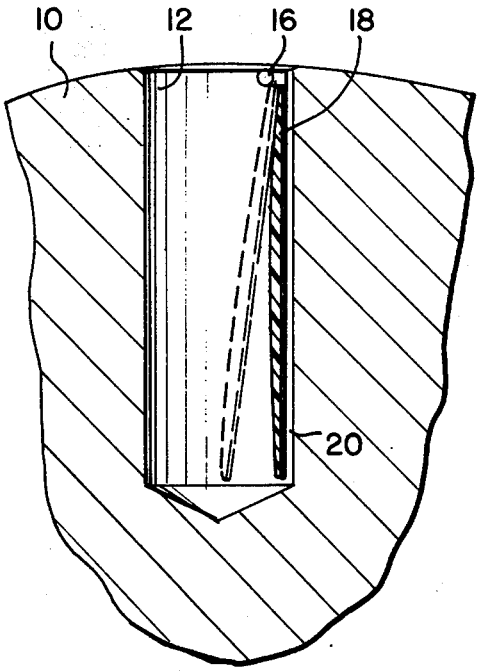
FIG. 2

BOWLING BALL AND GRIPPING DEVICE

BACKGROUND OF THE INVENTION

This invention relates to bowling balls; more particularly, to a gripping device that is adapted to be inserted into the digit receiving apertures of a bowling ball in order to conform the aperture to the approximate girth of the digit.

The prior art bowling ball are deficient because they require permanent alteration of the ball; they require the construction of a non-conventional ball; they are not adaptable for everyone's fingers but only the one for whom the ball was designed; and they fail to provide an affective means of conforming the digit aperture to the user.

SUMMARY OF THE INVENTION

It is accordingly an object of the instant invention to avoid one or more drawbacks of the prior art.

It is a further object to provide for an improved ball gripping device that is universal.

It is another object to provide for an improved bowling ball.

It is yet another object to provide for the gripping device at relatively little cost thereby making it generally available.

These and other objects and advantages of the invention will become more apparent from the following detailed disclosure and claims and by reference to the accompanying drawings in which:

FIG. 1 is a perspective view, partly in section showing one embodiment;

FIG. 2 is a sectional view of a further embodiment; and

FIG. 3 is an enlarged view of the ball and adjoining mechanism.

Broadly speaking, the instant invention includes the provision of a bowling ball finger or thumb hole insert, comprising an elongated rigid member adapted to be inserted into the hole, spring means in communication with the member whereby the member is urged between a forward and relaxed position defining an angle of approximately 45° with the hole and a rearward, compressed and tensioned position defining an angle of approximately 180° with the hole being substantially parallel with the inner wall surface of the hole, the finger or thumb adapted to contact the member whereby the spring means is compressed and tensioned.

DETAILED DISCLOSURE

Referring more particularly to the drawings, there is shown a bowling ball 10 having circumferentially spaced radial finger holes 12, 14, adapted to receive the thumb 12*a* and middle finger 14*a* respectively. The fingers 14*a*, 12*a* are engaged in the usual way and to the usual depth.

In one embodiment of the invention, as is shown in FIG. 2, a spring 16 loaded rigid insert member 18 is longitudinally disposed in the finger hole 12. The insert 18 is of approximately the same length as the depth of the hole 12 though it need not be, such that it may easily move between a relaxed, forward position (as shown by the dotted lines) whereby it forms an angle of less than about 45° with the hole 12 and is disposed substantially diagonally across the hole 12. The other position is one of tension and contraction (as shown by hatch lines) where it defines an angle of approximately 180° and is disposed substantially parallel with the walls 20 of the hole 12. Insertion of a finger into the hole 12 contacts the member 18 and pressure causes the member 18 to move toward the wall 20, the spring member 16 providing the pivotal point and the required degree of resistance to maintain the and urge the member 18 towards the finger.

Another embodiment features a similar spring 16′ loaded member 18 however, herein instead of the spring means 16′ being at one distal end of the member 18, the spring member is disposed at a point such that it contacts approximately the mid-section of the member 18. In the embodiment, a radial channel 24 is disposed in the ball 10 at an angle of approximately 45° to the finger hole 12, 14, the channel 24 will communicate with the holes 12, 14 though not necessarily with the exterior surface of the ball 10 as the holes 12, 14 do. The insert 18 will move in the same fashion as in the embodiment shown in FIG. 2, however, the spring means 16′ will be disposed in the channel 24 and be in contact with the member 16′ which they will urge for movement. In this embodiment, the means 16′ and member 18 can be removable or may be integral with a ball 10.

In either embodiment, the member 18 can have a treated surface or substance applied thereto to provide a roughened area for contact with the fingers.

Since it is obvious that numerous changes and modifications can be made in the above described details without departing from the spirit and nature of the invention, it is to be understood that all such changes and modifications are included within the scope of the invention.

I claim:

1. A bowling ball finger or thumb hole insert, comprising an elongated rigid member adapted to be inserted into said hole, spring means in communication with said member whereby said member is urged between a forward and relaxed position extending generally diagonally of said hole and a rearward, compressed and tensioned position extending substantially parallel with the inner wall surface of said hole, said finger or thumb adapted to contact said member whereby said spring means is compressed and tensioned.

2. The insert as defined in claim 1 wherein said spring means is disposed adjacent a distal end of said member.

3. The insert as defined in claim 1 wherein said spring means are in contact with said member at about the mid point thereof.

4. The insert as defined in claim 1 wherein said member is non-compressible.

5. The insert as defined in claim 1 wherein one surface of said member has a convex side.

6. The insert as defined in claim 1 wherein said member includes a roughened surface adapted to contact said finger or thumb.

7. An improved bowling ball having at least one cylindrical digit hole adapted to receive a finger or thumb and the insert as defined in claim 1.

8. An improved bowling ball as defined in claim 7 further including the insert as defined in claim 3 and at least one radially disposed channel communicating with said hole and defining an angle of about 45° therewith, said spring means disposed in said channel.

* * * * *